US011257453B2

(12) United States Patent
Xue

(10) Patent No.: US 11,257,453 B2
(45) Date of Patent: Feb. 22, 2022

(54) BLUEPHASE LIQUID CRYSTAL PIXEL CIRCUIT, DRIVING METHOD THEREOF, AND DISPLAY DEVICE

(71) Applicant: SHENZHEN CHINA STAR OPTOELECTRONICS SEMICONDUCTOR DISPLAY TECHNOLOGY CO., LTD., Shenzhen (CN)

(72) Inventor: Yan Xue, Shenzhen (CN)

( * ) Notice: Subject to any disclaimer, the term of this patent is extended or adjusted under 35 U.S.C. 154(b) by 133 days.

(21) Appl. No.: 16/767,502

(22) PCT Filed: May 9, 2020

(86) PCT No.: PCT/CN2020/089425
§ 371 (c)(1),
(2) Date: May 27, 2020

(87) PCT Pub. No.: WO2021/169044
PCT Pub. Date: Sep. 2, 2021

(65) Prior Publication Data

US 2021/0407448 A1 Dec. 30, 2021

(30) Foreign Application Priority Data

Feb. 27, 2020 (CN) ..... 202010125569.6

(51) Int. Cl.
*G09G 3/36* (2006.01)

(52) U.S. Cl.
CPC ..... *G09G 3/3659* (2013.01); *G09G 3/3655* (2013.01); *G09G 2300/043* (2013.01); *G09G 2310/0262* (2013.01)

(58) Field of Classification Search
CPC ..... G09G 3/3659; G09G 3/3655; G09G 2300/043; G09G 2310/0262
See application file for complete search history.

(56) References Cited

U.S. PATENT DOCUMENTS

| | | | | |
|---|---|---|---|---|
| 9,129,553 | B2 * | 9/2015 | Yamashita | G09G 3/3233 |
| 10,446,638 | B2 * | 10/2019 | Seo | H01L 27/3276 |
| 2008/0001545 | A1 * | 1/2008 | Uchino | G09G 3/3208 315/175 |
| 2020/0294449 | A1 * | 9/2020 | Wang | G09G 3/3258 |

* cited by examiner

*Primary Examiner* — Chanh D Nguyen
*Assistant Examiner* — Ngan T. Pham-Lu

(57) ABSTRACT

A bluephase liquid crystal pixel circuit, which includes first to fifth electrical switches, a first capacitance, and a second capacitance. According to the bluephase liquid crystal pixel circuit, a data signal voltage of a panel can be significantly lowered to achieve a purpose of reducing power consumption, and a compensation effect for a threshold voltage may also be realized.

20 Claims, 5 Drawing Sheets

| Signals | Voltage setting | |
|---|---|---|
| | Max. value (V) | Min. value (V) |
| Data | +5 | +10 |
| Scan1 | -6 | +15 |
| Scan2 | -6 | +15 |
| EM | -6 | +40 |
| Vini | +1 | |
| VDD | +30 | |
| VSS | 0 | |

| Stage | States of electrical switches or voltage value (unit: V) | | | | | | | | | | | |
|---|---|---|---|---|---|---|---|---|---|---|---|---|
| | Data | Scan1 | Scan2 | VDD | EM | Vini | Vref | T1 | T2 | T3 | T4 | T5 |
| Initial | +5 | -6 | -6 | +30 | -6 | +1 | +5 | on | off | off | on | on |
| A1 | +5 | +15<br>-6 | +15 | +30 | -6 | +1 | +5 | on | on | on | off | off |
| A2 | +5 | +15 | -6 | +30 | +40 | +1 | +5 | on | on | off | on | on |
| A3 | +10 | +15 | -6 | +30 | -6 | +1 | +5 | on | on | off | off | off |
| A4 | +10<br>+5 | -6 | -6 | +30 | +40 | +1 | +5 | on | off | off | on | on |

BLUEPHASE LIQUID CRYSTAL PIXEL CIRCUIT, DRIVING METHOD THEREOF, AND DISPLAY DEVICE

TECHNICAL FIELD

The present invention relates to a liquid crystal display technology field, in particular to a bluephase liquid crystal pixel circuit, a driving method thereof, and a display device.

BACKGROUND

Due to rise of global information society and development of technology, a field of display technology is changing rapidly, and there are more and more types of display technology which include traditional liquid crystal display technology, bluephase liquid crystal display technology, organic light-emitting diode (OLED) display technology, electrophoretic display technology, and the like. Bluephase liquid crystal display devices have advantages of a sub-millimeter response time, simple preparation processes, wide viewing angles, etc., and have attracted more and more attention from industries and researchers around the world. However, a main feature of bluephase liquid crystals is that liquid crystal molecules require to be driven by a higher data voltage in general. For example, for a conventional liquid crystal panel adopting a pixel circuit having a structure of 1T1C (one transistor and one capacitance), a data signal voltage is generally not less than 30V, and according to a dynamic power consumption calculation formula p=fcV2, dynamic power consumption is proportional to square of the data signal voltage, and under a case of high data signal voltage, panels have large power consumption.

Technical Problem

In view of this, the present invention provides a bluephase liquid crystal pixel circuit, a driving method thereof, and a display device to lower a data signal voltage of a liquid crystal panel, thereby reducing power consumption of the panel.

Technical Solution

Embodiments of the present invention provide the following technical solutions:

According to one aspect of the present invention, the present invention provides a bluephase liquid crystal pixel circuit, adopting a structure with 5T2C (five electrical switches and two capacitors) and applied to a liquid crystal display device to drive a light emitting diode to emit light, the bluephase liquid crystal pixel circuit comprises:

a first electrical switch, a second electrical switch, a third electrical switch, a fourth electrical switch, a fifth electrical switch, a first capacitor, and a second capacitor, wherein a first terminal of the first electrical switch is connected to a second terminal of the fourth electrical switch, a second terminal of the first electrical switch is connected to a second terminal of the third electrical switch, a first terminal of the fifth electrical switch, and a second terminal of the first capacitor at a first node;

wherein a control terminal of the second electrical switch is connected to a first scan line to receive a first scan signal, a first terminal of the second electrical switch is connected to a data line to receive a data signal voltage, and a second terminal of the second electrical switch is connected to a control terminal of the first electrical switch and a first terminal of the first capacitor at a second node;

wherein a control terminal of the third electrical switch is connected to a second scan line to receive a second scan signal, and a first terminal of the third electrical switch is connected to an initial potential line to receive a default initial voltage;

wherein a control terminal of the fourth electrical switch is connected to a third scan signal line to receive a third scan signal, and is connected to a control terminal of the fifth electrical switch, and a first terminal of the fourth electrical switch is connected to a power line to receive a power signal;

wherein a second terminal of the fifth electrical switch is connected to a first terminal of the second capacitor and an anode of a light emitting diode at a third node, and a cathode of the light emitting diode is connected to a first reference potential line to receive a first reference voltage; and wherein a second terminal of the second capacitor is connected to a common ground.

Further, the third scan signal line is a row scan signal line, and the third scan signal is a row scan signal.

Further, the first to the fifth electrical switches are NPN field effect transistors.

Further, the first to the fifth electrical switches are NPN field effect transistors, and the control terminals, the first terminals, and the second terminals of the first to the fifth electrical switches are gates, drains, and sources, respectively.

Further, the first to the fifth electrical switches are thin film transistors.

Further, the first to the fifth electrical switches are indium gallium zinc oxide (IGZO) thin film transistors.

Further, the third scan signal is a row scan signal.

Further, the third scan signal EM is a row scan signal.

Further, the first reference voltage is 0V.

According to another aspect of the present invention, the present invention provides a method for driving a bluephase liquid crystal pixel circuit, applied to the bluephase liquid crystal pixel circuit described above and comprising steps of:

a first stage: raising the first scan signal to a high potential, raising the second scan signal to a high potential, lowering the third scan signal to a low potential, loading the first terminal of the second electrical switch with a default reference voltage (Vref), turning on the second electrical switch and the third electrical switch, turning off the fourth electrical switch and the fifth electrical switch, and resetting the first node and the second node to the default initial voltage (Vini) and the default reference voltage (Vref), respectively;

a second stage: raising the third scan signal to a high potential, turning on the fourth electrical switch and the fifth electrical switch, maintaining a high potential at the first terminal of the first electrical switch, lowering the second scan signal to a low potential, turning off the third electrical switch, and raising a voltage of the first node to a difference obtained by subtracting a threshold voltage of the first electrical switch from the default reference voltage (Vref-Vth);

a third stage: lowering the third scan signal to a low potential, turning off the fourth electrical switch and the fifth electrical switch, maintaining the high potential of the first scan signal, loading the first terminal of the second electrical switch with the data signal voltage, and writing the data signal voltage to the second node; and a fourth stage: raising the third scan signal to a high potential, turning on the fourth electrical switch and the fifth electrical switch, raising potentials of the first node and the third node, raising the second node to a high potential, maintaining the first electrical switch in a turning-on state, and finally raising the potentials of the first node and the third node to a high potential.

Further, timing of the first scan signal and the second scan signal are different, and absolute values of maximum voltage values of the first scan signal and the second scan signal are same.

According to another aspect of the present invention, the present invention provides a display device, comprising the bluephase liquid crystal pixel circuit described above.

Beneficial Effect

According to the technical solutions of the present invention, by adopting a pixel circuit described in the present invention, it is not necessary to use a higher data voltage, and the data voltage used in a liquid crystal panel can be significantly lowered. Since dynamic power consumption of data is proportional to the square of the data voltage, power consumption of the panel can be significantly reduced by lowering the data voltage. Moreover, the circuit, method and device provided by the present invention have a compensation effect for a threshold voltage (Vth), which is conductive to improving uniformity of display brightness. Of course, when the present invention is implemented on any product or method, it is not necessary to achieve all the advantages mentioned above at the same time.

DESCRIPTION OF DRAWINGS

In order to clearly illustrate specific embodiments of the present invention or technical solutions in the prior art, a brief description for drawings used in the description of the specific embodiments or the prior art would be given as below. Obviously, the drawings in the following description is merely some embodiments of the present invention. For persons skilled in this art, other drawings can be obtained from these drawings under the premise of no creative efforts made.

The components in the drawings are not drawn to scale, and are only for illustrating principles of the present invention. In order to facilitate illustrations and descriptions of some parts of the present invention, corresponding parts in the drawings may be enlarged, that is, to allow them larger than other parts in an exemplary device actually manufactured according to the present invention. In the drawings, same or similar technical features or components will be denoted by same or similar reference signs.

DETAILED DESCRIPTION OF PREFERRED EMBODIMENTS

Technical solutions in embodiments of the present application will be clearly and completely described below in conjunction with drawings in the embodiments of the present application. Obviously, the embodiments described are only a portion of embodiments of the present application, not all of them. Based on the embodiments of the present application, other embodiments obtained by persons skilled in this art without making creative efforts fall within a protection scope of the present application.

First Embodiment

Figure 1:
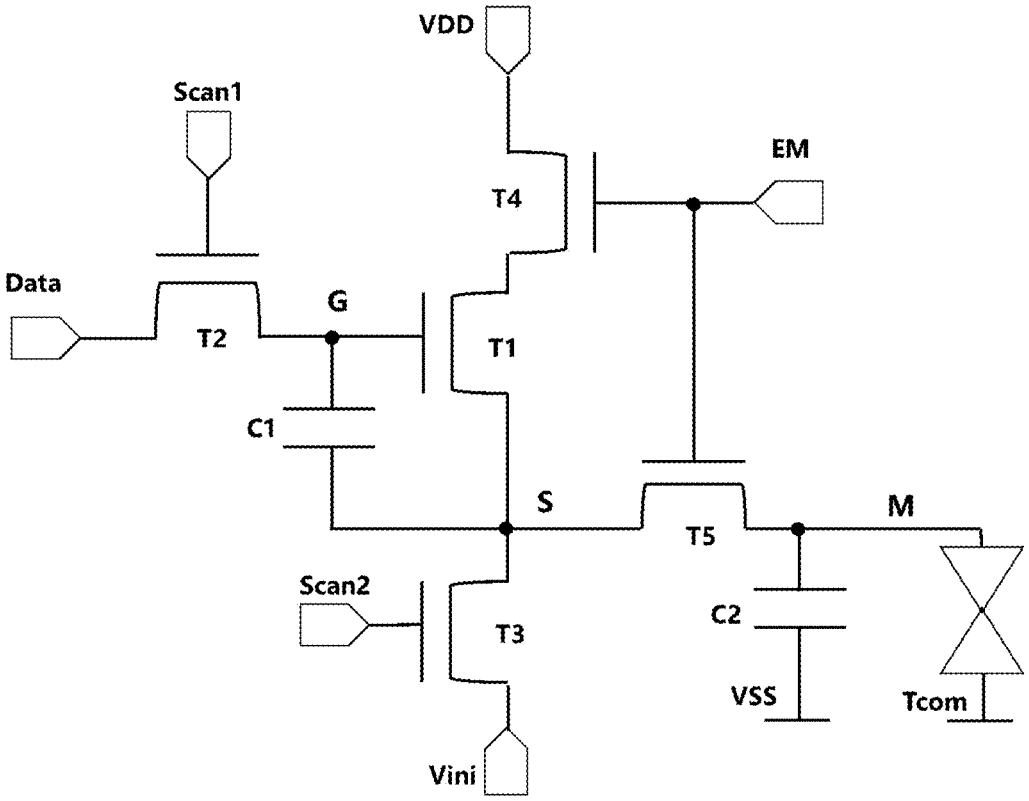
FIG. 1 is a schematic structural diagram showing a bluephase liquid crystal pixel circuit according to one embodiment of the present invention.

According to a first embodiment of the present invention, a bluephase liquid crystal pixel circuit is provided, which adopts a structure of 5T2C. FIG. 1 is a schematic structural diagram showing a bluephase liquid crystal pixel circuit according to one embodiment of the present invention. As shown in FIG. 1, the circuit includes:

a first electrical switch T1, a second electrical switch T2, a third electrical switch T3, a fourth electrical switch T4, a fifth electrical switch T5, a first capacitor C1, and a second capacitor C2.

A first terminal of the first electrical switch T1 is connected to a second terminal of the fourth electrical switch T4, and a second terminal of the first electrical switch T1 is connected to a second terminal of the third electrical switch T3, a first terminal of the fifth electrical switch T5, and a second terminal of the first capacitor C1 at a first node S.

A control terminal of the second electrical switch T2 is connected to a first scan line to receive a first scan signal Scan1, a first terminal of the second electrical switch T2 is connected to a data line to receive a data signal voltage Data, and a second terminal of the second electrical switch T2 is connected to a control terminal of the first electrical switch T1 and a first terminal of the first capacitor C1 at a second node G.

A control terminal of the third electrical switch T3 is connected to a second scan line to receive a second scan signal Scan2, and a first terminal of the third electrical switch T3 is connected to an initial potential line to receive a default initial voltage Vini.

A control terminal of the fourth electrical switch T4 is connected to a third scan signal line to receive a third scan signal EM, and is connected to a control terminal of the fifth electrical switch T5, and a first terminal of the fourth electrical switch T4 is connected to a power line to receive a power signal VDD.

A second terminal of the fifth electrical switch T5 is connected to a first terminal of the second capacitor C2 and an anode of a light emitting diode at a third node M, and a cathode of the light emitting diode is connected to a first reference potential line to receive a first reference voltage Tcom.

A second terminal of the second capacitor C2 is connected to a common ground VSS.

In one embodiment, the third scan signal line is a row scan signal line, the third scan signal EM is a row scan signal.

In one embodiment, the first to the fifth electrical switches T1-T5 are NPN field effect transistors.

In one embodiment, the first to the fifth electrical switches T1-T5 are NPN field effect transistors, and the control terminals, the first terminals, and the second terminals of the first to the fifth electrical switches T1-T5 are gates, drains, and sources, respectively.

In one embodiment, the first to the fifth electrical switches T1-T5 are indium gallium zinc oxide (IGZO) thin film transistors.

In one embodiment, the third scan signal EM is a row scan signal.

In one embodiment, the cathode of the light emitting diode is grounded, and the first reference voltage Tcom is 0V.

It should be noted that the schematic structural diagram of the pixel circuit in FIG. 1 is a circuit structure corresponding to one light emitting device, and the above description is illustrated with a pixel circuit corresponding to one light emitting device. The actual display is composed of a pixel array with multiple pixels, there are also multiple corresponding circuit units.

Figures 3, 4:
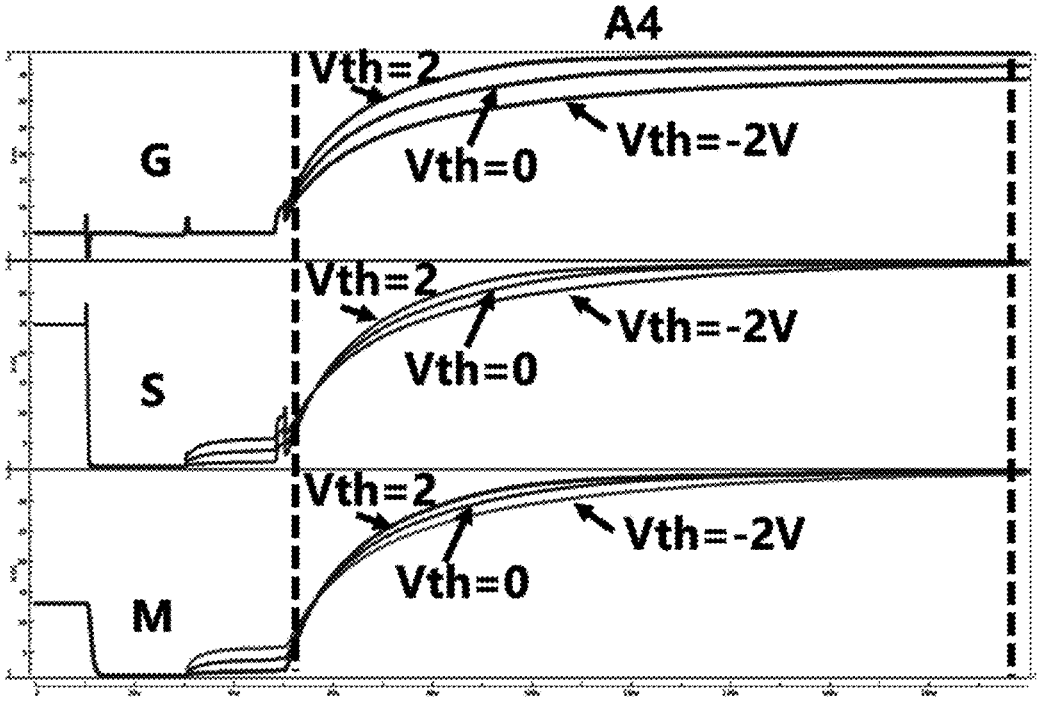
FIG. 3 is a table exemplarily showing values or amplitude values of key signals for a bluephase liquid crystal pixel circuit according to one embodiment of the present invention.
FIG. 4 is a schematic diagram showing a compensation effect for a threshold voltage for a bluephase liquid crystal pixel circuit according to one embodiment of the present invention.
Figure 5:
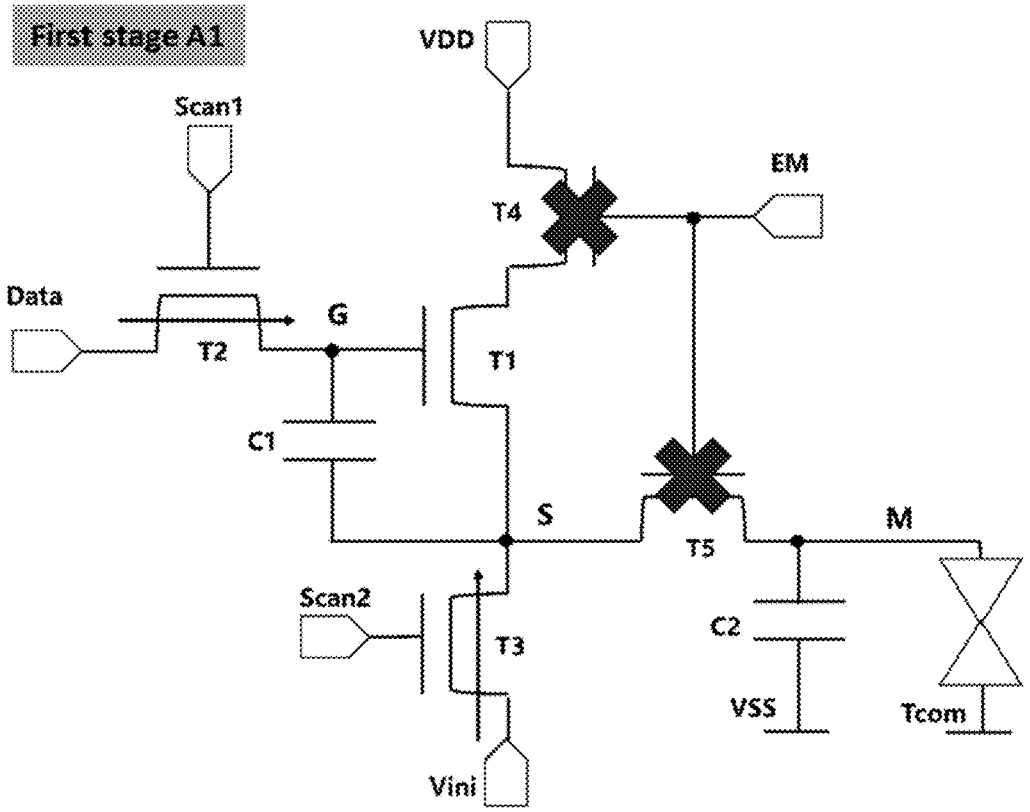
FIG. 5 is a schematic diagram showing a circuit working state in a first phase of a method for driving a bluephase liquid crystal pixel circuit according to one embodiment of the present invention.
Figure 6:
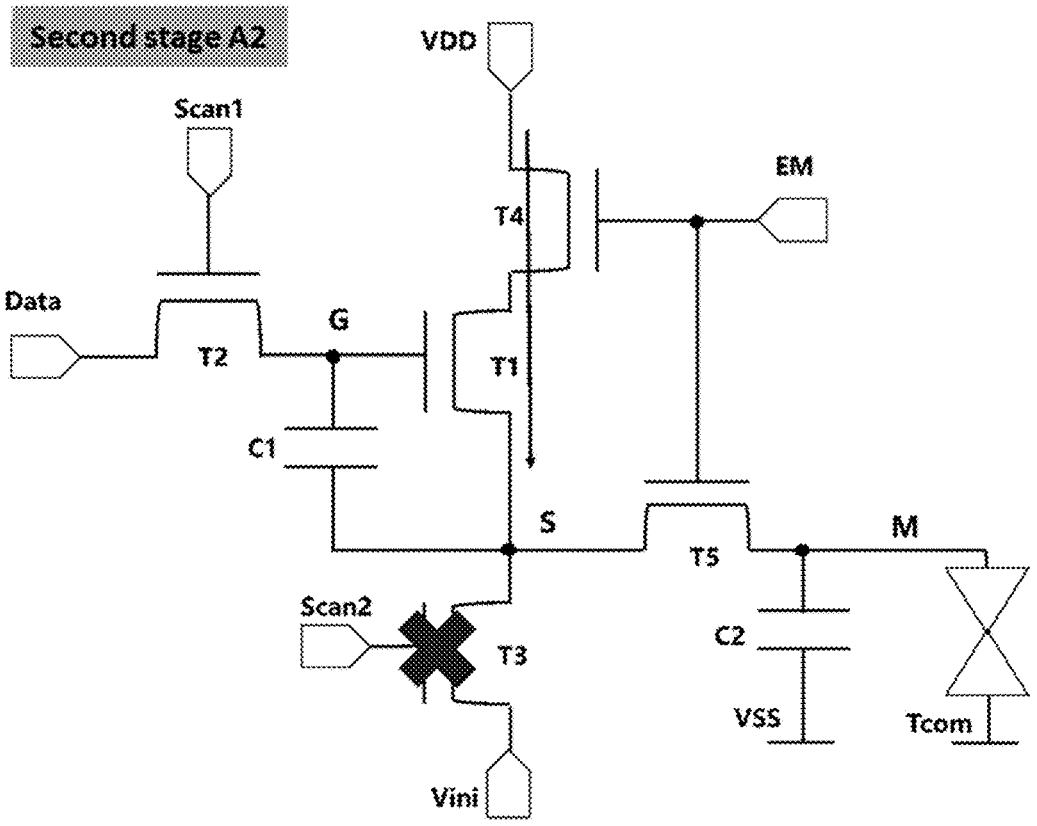
FIG. 6 is a schematic diagram showing a circuit working state in a second phase of the method for driving the bluephase liquid crystal pixel circuit according to one embodiment of the present invention.
Figure 7:
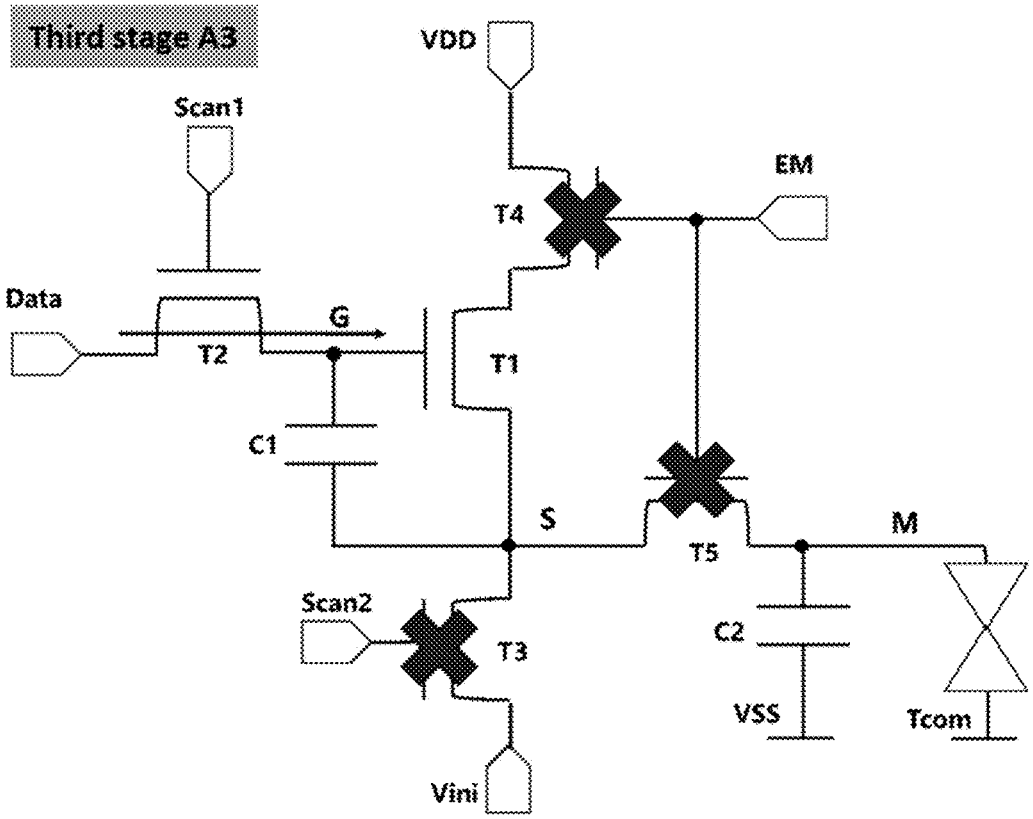
FIG. 7 is a schematic diagram showing a circuit working state in a third phase of the method for driving the bluephase liquid crystal pixel circuit according to one embodiment of the present invention.
Figure 8:
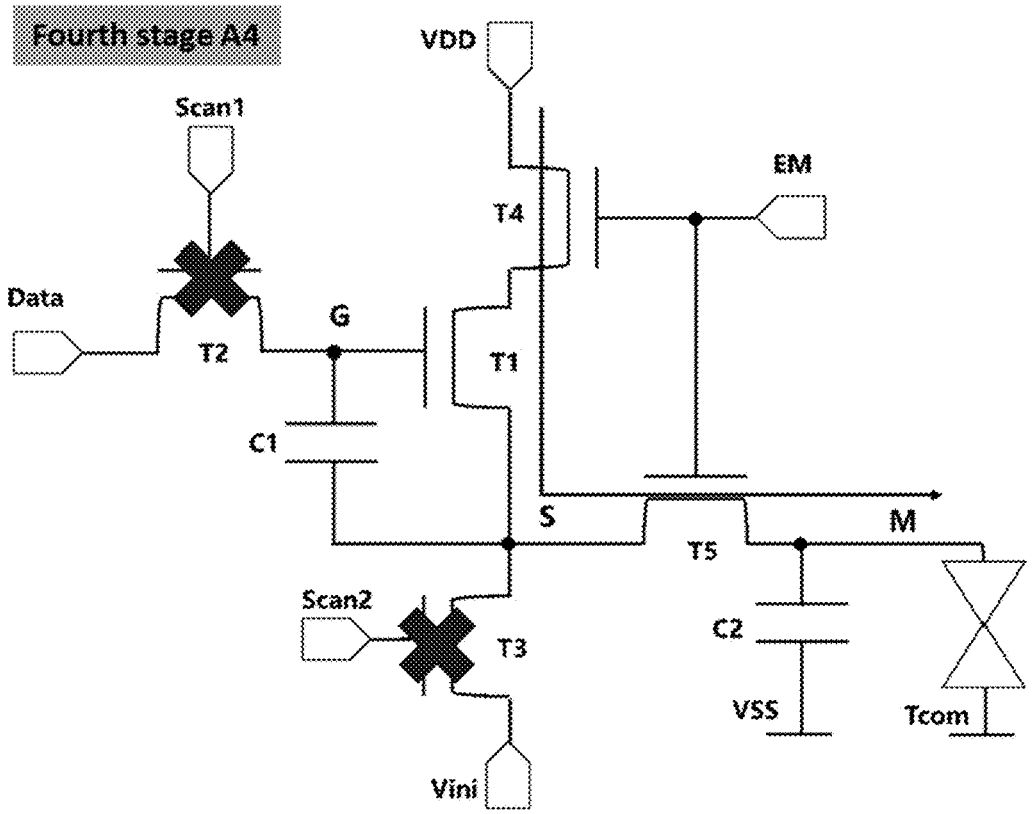
FIG. 8 is a schematic diagram showing a circuit working state in a fourth phase of the method for driving the bluephase liquid crystal pixel circuit according to one embodiment of the present invention.
Figures 9, 10:
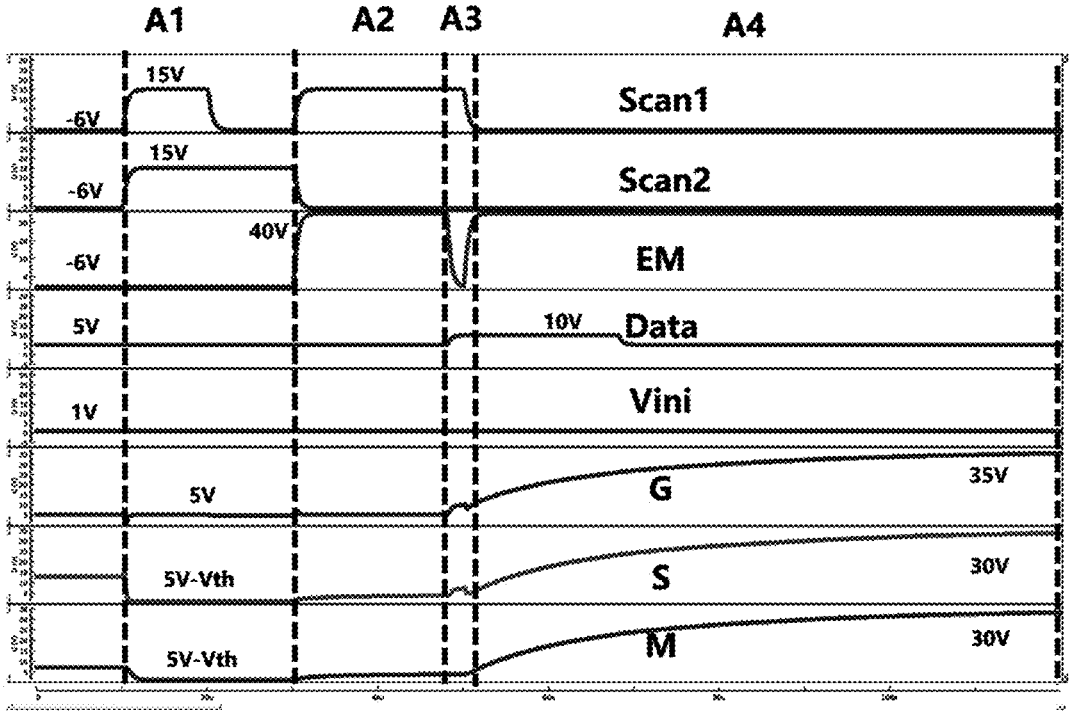
FIG. 9 is a table exemplarily showing a circuit working state of key components and key parameters for a blue phase liquid crystal pixel circuit and a driving method thereof according to one embodiment of the present invention.
FIG. 10 is a timing diagram showing key parameters for a bluephase liquid crystal pixel circuit and a driving method thereof according to one embodiment of the present invention.

Refer to FIG. 3, it shows values or ranges of values of key signals for a pixel circuit according to one embodiment. In the present embodiment, a maximum value of the data signal voltage Data is 10 v. Compared to some data signal voltage which is generally not less than 30V in the prior art, the data signal voltage is significantly lowered, and according to a dynamic power consumption calculation formula p=fcV2, dynamic power consumption is proportional to the square of the data signal voltage. Under a case of low data signal voltage, power consumption of a panel is reduced. By adopting the circuit provided by the present invention to drive liquid crystal pixels, a relatively low data signal voltage can be used to drive the liquid crystal pixels, so that power consumption of a liquid crystal panel can be reduced.

Figure 2:
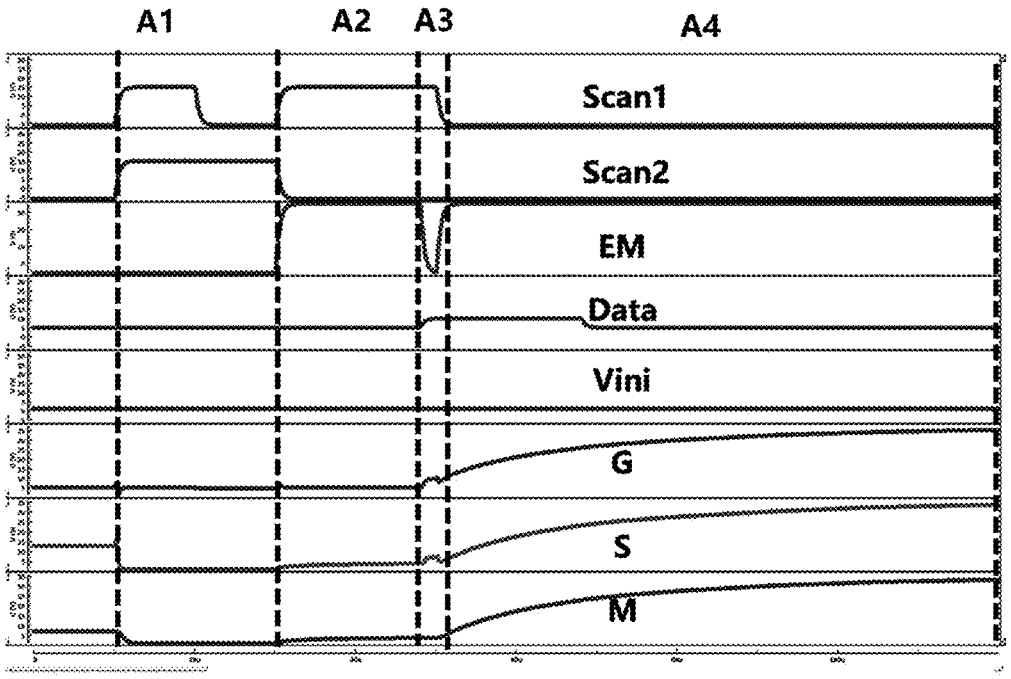
FIG. 2 is a timing diagram showing key signals for a bluephase liquid crystal pixel circuit and driving method thereof according to one embodiment of the present invention.

In one embodiment, refer to FIGS. 1 and 2, a circuit working state for pixels is as follows:

A first stage A1: raising the first scan signal Scan1 to a high potential, raising the second scan signal Scan2 to a high potential, lowering the third scan signal EM to a low potential, loading the first terminal of the second electrical switch T2 with a default reference voltage (Vref), turning on the second electrical switch T2 and the third electrical switch T3, turning off the fourth electrical switch T4 and the fifth electrical switch T5, and resetting the first node S and the second node G to the default initial voltage (Vin) and the default reference voltage (Vref), respectively.

A second stage A2: raising the third scan signal EM to a high potential, turning on the fourth electrical switch T4 and the fifth electrical switch T5, maintaining a high potential at the first terminal of the first electrical switch T1, lowering the second scan signal Scan2 to a low potential, turning off the third electrical switch T3, and raising a voltage of the first node S to a difference obtained by subtracting a threshold voltage of the first electrical switch T1 from the default reference voltage (Vref-Vth).

A third stage A3: lowering the third scan signal EM to a low potential, turning off the fourth electrical switch T4 and the fifth electrical switch T5, maintaining the high potential of the first scan signal Scan1, loading the first terminal of the second electrical switch T2 with the data signal voltage Data, and writing the data signal voltage Data to the second node G.

A fourth stage A4: raising the third scan signal EM to a high potential, turning on the fourth electrical switch T4 and the fifth electrical switch T5, raising potentials of the first node S and the third node M, raising the second node G to a high potential, maintaining the first electrical switch T1 in a turning-on state, and finally raising the potentials of the first node S and the third node M to a high potential.

In the fourth stage A4, a potential difference between the first node S and the second node G is VGS=Data−(Vref−Vth). For the first electrical switch T1, VGS−Vth=Data−(Vref−Vth)−Vth=Data−Vref. It can be seen that a current passing through the first electrical switch T1 is independent of the threshold voltage Vth of the first electrical switch T1. Therefore, a compensation effect for the threshold voltage is realized by the pixel circuit according to one embodiment of the present invention.

Refer to FIG. 4, which is a schematic diagram showing a compensation effect for a threshold voltage for a pixel circuit according to one embodiment. When the threshold voltage Vth of the first electrical switch T1 is positively biased by 2V, negatively biased by −2V, and unbiased, point potential changes of the first node S, the second node G, and the third node M can be seen from FIG. 4. It can be understood from FIG. 4, the point potential of M remains the same eventually, and it is independent of the threshold voltage Vth of the first electrical switch T1.

Second Embodiment

According to a second embodiment of the present invention, a method for driving a bluephase liquid crystal pixel circuit is provided, which is applied to the bluephase liquid crystal pixel circuit mentioned above:

In one embodiment, refer to FIGS. 1-3 and 5-8, the method for driving the bluephase liquid crystal pixel circuit includes steps of:

A first stage A1: raising the first scan signal Scan1 to a high potential, raising the second scan signal Scan2 to a high potential, lowering the third scan signal EM to a low potential, loading the first terminal of the second electrical switch T2 with a default reference voltage (Vref), turning on the second electrical switch T2 and the third electrical switch T3, turning off the fourth electrical switch T4 and the fifth electrical switch T5, and resetting the first node S and the second node G to the default initial voltage (Vini) and the default reference voltage (Vref), respectively.

A second stage A2: raising the third scan signal EM to a high potential, turning on the fourth electrical switch T4 and the fifth electrical switch T5, maintaining a high potential at the first terminal of the first electrical switch T1, lowering the second scan signal Scan2 to a low potential, turning off the third electrical switch T3, and raising a voltage of the first node S to a difference obtained by subtracting a threshold voltage of the first electrical switch T1 from the default reference voltage (Vref-Vth).

A third stage A3: lowering the third scan signal EM to a low potential, turning off the fourth electrical switch T4 and the fifth electrical switch T5, maintaining the high potential of the first scan signal Scan1, loading the first terminal of the second electrical switch T2 with the data signal voltage Data, and writing the data signal voltage Data to the second node G.

A fourth stage A4: raising the third scan signal EM to a high potential, turning on the fourth electrical switch T4 and the fifth electrical switch T5, raising potentials of the first node S and the third node M, raising the second node G to a high potential, maintaining the first electrical switch T1 in a turning-on state, and finally raising the potentials of the first node S and the third node M to a high potential.

In one embodiment, refer to FIGS. 1-3 and 5-10, a method for driving the bluephase liquid crystal pixel circuit includes steps of:

A first stage A1: raising the first scan signal Scan1 to a high potential +15V, raising the second scan signal Scan2 to a high potential +15V, lowering the third scan signal EM to a low potential −6V, loading the first terminal of the second electrical switch T2 with a default reference voltage (Vref=+5V), turning on the second electrical switch T2 and the third electrical switch T3, turning off the fourth electrical switch T4 and the fifth electrical switch T5, and resetting the first node S and the second node G to the default initial voltage (Vini=+1V) and the default reference voltage (Vref=+5V), respectively.

A second stage A2: raising the third scan signal EM to a high potential +40V, turning on the fourth electrical switch T4 and the fifth electrical switch T5, maintaining a high potential +30V at the first terminal of the first electrical switch T1, lowering the second scan signal Scan2 to a low potential −6V, turning off the third electrical switch T3, and raising a voltage of the first node S to a difference obtained by subtracting a threshold voltage of the first electrical switch T1 from the default reference voltage (Vref−Vth=5V−Vth).

A third stage A3: lowering the third scan signal EM to a low potential −6V, turning off the fourth electrical switch T4 and the fifth electrical switch T5, maintaining the high potential +15V of the first scan signal Scan1, loading the first terminal of the second electrical switch T2 with the data signal voltage Data=10V, and writing the data signal voltage Data=+10V to the second node G.

A fourth stage A4: raising the third scan signal EM to a high potential +40V, turning on the fourth electrical switch T4 and the fifth electrical switch T5, raising potentials of the first node S and the third node M, raising the second node G to a high potential +35V, maintaining the first electrical switch T1 in a turning-on state, and finally raising the potentials of the first node S and the third node M to a high potential +30V.

Wherein, the first stage A1 is a resetting stage, the second stage A2 is a threshold voltage extraction stage, the third stage A3 is a data writing stage, and the fourth stage A4 is a light-emitting stage.

It should be noted that, in some embodiments, in the first stage A1, the first scan signal Scan1 may also be rise to the high potential +15V, and then the first scan signal Scan' is lowered to a low potential −6V in a later stage of the first stage A1 (but the first scan signal Scan1 is still raised to a high potential +15V in the second stage A2). In some embodiments, in the fourth stage A4, the data signal voltage Data in an early stage of the fourth stage A4 can also be +10V, and the data signal voltage Data in a later stage of the fourth stage A4 is +5V.

Third Embodiment

According to a third embodiment of the present invention, a display device is provided, which includes a bluephase liquid crystal pixel circuit, and a single liquid crystal pixel circuit includes:

a first electrical switch T1, a second electrical switch T2, a third electrical switch T3, a fourth electrical switch T4, a fifth electrical switch T5, a first capacitor C1, and a second capacitor C2.

A first terminal of the first electrical switch T1 is connected to a second terminal of the fourth electrical switch T4, and a second terminal of the first electrical switch T1 is connected to a second terminal of the third electrical switch T3, a first terminal of the fifth electrical switch T5, and a second terminal of the first capacitor C1 at a first node S.

A control terminal of the second electrical switch T2 is connected to a first scan line to receive a first scan signal Scan1, a first terminal of the second electrical switch T2 is connected to a data line to receive a data signal voltage Data, and a second terminal of the second electrical switch T2 is connected to a control terminal of the first electrical switch T1 and a first terminal of the first capacitor C1 at a second node G.

A control terminal of the third electrical switch T3 is connected to a second scan line to receive a second scan signal Scan2, and a first terminal of the third electrical switch T3 is connected to an initial potential line to receive a default initial voltage Vini.

A control terminal of the fourth electrical switch T4 is connected to a third scan signal line to receive a third scan signal EM, and is connected to a control terminal of the fifth electrical switch T5, and a first terminal of the fourth electrical switch T4 is connected to a power line to receive a power signal VDD.

A second terminal of the fifth electrical switch T5 is connected to a first terminal of the second capacitor C2 and an anode of a light emitting diode at a third node M, and a cathode of the light emitting diode is connected to a first reference potential line to receive a first reference voltage Tcom.

A second terminal of the second capacitor C2 is connected to a common ground VSS.

In one embodiment, the third scan signal line is a row scan signal line, the third scan signal EM is a row scan signal.

In one embodiment, the first to the fifth electrical switches T1-T5 are NPN field effect transistors.

In one embodiment, the first to the fifth electrical switches T1-T5 are NPN field effect transistors, and the control terminals, the first terminals, and the second terminals of the first to the fifth electrical switches T1-T5 are gates, drains, and sources, respectively.

In one embodiment, the first to the fifth electrical switches T1-T5 are indium gallium zinc oxide (IGZO) thin film transistors.

In one embodiment, the third scan signal EM is a row scan signal.

In one embodiment, the cathode of the light emitting diode is grounded, and the first reference voltage Tcom is 0V.

Persons skilled in this art may understand that the above description does not constitute a limitation on electronic devices, and more or less components, combinations of some components, or arrangements of different components may be included.

It should be noted that in the description of the present application, terms such as "first", "second" are merely used for illustrating the objectives, and are not to be understood as indicating or implying relative importance or implying a number of technical features indicated. Thus, the features defined as "first" and "second" may explicitly or implicitly include one or more features. In the description of the present application, unless otherwise specifically stated, "multiple" means two or more. Moreover, terms "including", "including" or any other variant thereof are intended to cover non-exclusive inclusions, so that processes, methods, objects or devices including series factors do not only include those factors, but also further include other factors that are not explicitly listed, or further include factors that are inherent to the processes, methods, objects, or devices. Without more restrictions, factors defined by a sentence "include one . . . " do not exclude existence of other same factors in the processes, methods, objects, or devices including the factors. The embodiments in the present specification are described in a related manner. Same or similar parts among the embodiments can be referred to each other, and each of the embodiments focuses on differences from other embodiments. In particular, for embodiments of devices and electronic equipment, they basically have similar method embodiments, descriptions are relatively simple, and relevant parts can be referred to the descriptions of the method embodiments. The above description are only embodiments for the present invention, and are not intended to limit the protection scope of the present invention. Any modification, equivalent replacement, improvement, etc. made within spirit and principle of the present invention are included in the protection scope of the present invention. In the above description for the specific embodiments of the present invention, features described and/or illustrated for one embodiment may be used in one or more other embodiments in the same or similar manner, combine with features in other embodiments, or replace features in other embodiments.

In the present application, a term "exemplary" is used to mean "used as an example, illustration, or illustration." Any embodiment described as "exemplary" in the present application is not necessarily to be explained as more preferred or advantageous than other embodiments. In order to enable persons skilled in this art to implement and use the present application, a description is given. In the description, details are listed for a purpose of explaining. It should be understood that persons skilled in this art may recognize that the present application can also be implemented without using these specific details. In other embodiments, well-known structures and processes will not be described in detail for preventing unnecessary details from obscuring the description of the present application. Therefore, the present application is not intended to be limited to the illustrated embodiments, but is consistent with a widest scope of principles and features disclosed in the present application.

It should be emphasized that when terms "comprise/include" used herein, it refers to presence of features, factors, steps or components, but does not exclude presence or addition of one or more other features, factors, steps or components. Terms or subscripts involving ordinal numbers such as "one", "two", "1", "2", "n", "n−" do not necessarily indicate orders or importance of features, factors, steps, or components defined by these terms, they are only used to identify these features, factors, steps or components for clarity.

Although the embodiments of the present invention have been described with reference to the accompanying drawings, persons skilled in this art may make various modifications and alterations without departing from the spirit and scope of the present invention, and the modifications and variations fall within the scope of the appended claims.

INDUSTRY PRACTICALITY

According to the technical solutions of the present invention, by adopting a pixel circuit described in the present invention, it is not necessary to use a higher data voltage, and the data voltage used in a liquid crystal panel can be significantly lowered. Since dynamic power consumption of data is proportional to the square of the data voltage, power consumption of the panel can be significantly reduced by lowering the data voltage. Moreover, the circuit, the method and the device provided by the present invention have a compensation effect for a threshold voltage (Vth), which is conductive to improving uniformity of display brightness.

What is claimed is:

1. A bluephase liquid crystal pixel circuit, comprising:

a first electrical switch, a second electrical switch, a third electrical switch, a fourth electrical switch, a fifth electrical switch, a first capacitor, and a second capacitor, wherein a first terminal of the first electrical switch is connected to a second terminal of the fourth electrical switch, a second terminal of the first electrical switch is connected to a second terminal of the third electrical switch, a first terminal of the fifth electrical switch, and a second terminal of the first capacitor at a first node;

wherein a control terminal of the second electrical switch is connected to a first scan line to receive a first scan signal, a first terminal of the second electrical switch is connected to a data line to receive a data signal voltage, and a second terminal of the second electrical switch is connected to a control terminal of the first electrical switch and a first terminal of the first capacitor at a second node;

wherein a control terminal of the third electrical switch is connected to a second scan line to receive a second scan signal, and a first terminal of the third electrical switch is connected to an initial potential line to receive a default initial voltage;

wherein a control terminal of the fourth electrical switch is connected to a third scan signal line to receive a third scan signal, and is connected to a control terminal of the fifth electrical switch, and a first terminal of the fourth electrical switch is connected to a power line to receive a power signal;

wherein a second terminal of the fifth electrical switch is connected to the first terminal of the second capacitor and an anode of a light emitting diode at a third node, and a cathode of the light emitting diode is connected to a first reference potential line to receive a first reference voltage; and wherein a second terminal of the second capacitor is connected to a common ground.

2. The bluephase liquid crystal pixel circuit as claimed in claim 1, wherein the first to fifth electrical switches are thin film transistors.

3. The bluephase liquid crystal pixel circuit as claimed in claim 2, wherein the first to fifth electrical switches are indium gallium zinc oxide (IGZO) thin film transistors.

4. The bluephase liquid crystal pixel circuit as claimed in claim 1, wherein the first to fifth electrical switches are NPN field effect transistors.

5. The bluephase liquid crystal pixel circuit as claimed in claim 4, wherein the control terminals, the first terminals, and the second terminals of the first to fifth electrical switches are gates, drains, and sources, respectively.

6. The bluephase liquid crystal pixel circuit as claimed in claim 1, wherein the third scan signal is a row scan signal.

7. The bluephase liquid crystal pixel circuit as claimed in claim 2, wherein the third scan signal is a row scan signal.

8. The bluephase liquid crystal pixel circuit as claimed in claim 5, wherein the third scan signal is a row scan signal.

9. The bluephase liquid crystal pixel circuit as claimed in claim 1, wherein the first reference voltage is 0V.

10. The bluephase liquid crystal pixel circuit as claimed in claim 3, wherein the first reference voltage is 0V.

11. The bluephase liquid crystal pixel circuit as claimed in claim 5, wherein the first reference voltage is 0V.

12. A method for driving a bluephase liquid crystal pixel circuit, applied to the bluephase liquid crystal pixel circuit as claimed in claim 1, and comprising steps of:

a first stage: raising the first scan signal to a high potential, raising the second scan signal to a high potential, falling the third scan signal to a low potential, loading the first terminal of the second electrical switch with a default reference voltage, turning-on the second electrical switch and the third electrical switch, turning-off the fourth electrical switch and the fifth electrical switch, and resetting the first node and the second node to the default initial voltage and the default reference voltage, respectively;

a second stage: raising the third scan signal to a high potential, turning-on the fourth electrical switch and the fifth electrical switch, maintaining a high potential at the first terminal of the first electrical switch, falling the second scan signal to a low potential, turning-off the third electrical switch, and raising a voltage of the first node to a difference that the default reference voltage minus a threshold voltage of the first electrical switch;

a third stage: falling the third scan signal to a low potential, turning-off the fourth electrical switch and the fifth electrical switch, maintaining the high potential of the first scan signal, loading the first terminal of the second electrical switch with the data signal voltage, and writing the data signal voltage into a potential of the second node; and a fourth stage: raising the third scan signal to a high potential, turning-on the fourth electrical switch and the fifth electrical switch, raising potentials of the first node and the third node, raising the second node to a high potential, maintaining the first electrical switch in a turning-on state, and finally raising the potentials of the first node and the third node to a high potential.

13. The method as claimed in claim 12, wherein time sequences of the first scan signal and the second scan signal are different, and absolute values of maximum voltage values thereof are the same.

14. A display device, comprising a bluephase liquid crystal pixel circuit comprising:

a first electrical switch, a second electrical switch, a third electrical switch, a fourth electrical switch, a fifth electrical switch, a first capacitor, and a second capacitor, wherein a first terminal of the first electrical switch is connected to a second terminal of the fourth electrical switch, a second terminal of the first electrical switch is connected to a second terminal of the third electrical switch, a first terminal of the fifth electrical switch, and a second terminal of the first capacitor at a first node;

wherein a control terminal of the second electrical switch is connected to a first scan line to receive a first scan signal, a first terminal of the second electrical switch is connected to a data line to receive a data signal voltage, and a second terminal of the second electrical switch is connected to a control terminal of the first electrical switch and a first terminal of the first capacitor at a second node;

wherein a control terminal of the third electrical switch is connected to a second scan line to receive a second scan signal, and a first terminal of the third electrical switch is connected to an initial potential line to receive a default initial voltage;

wherein a control terminal of the fourth electrical switch is connected to a third scan signal line to receive a third scan signal, and is connected to a control terminal of the fifth electrical switch, and a first terminal of the fourth electrical switch is connected to a power line to receive a power signal;

wherein a second terminal of the fifth electrical switch is connected to the first terminal of the second capacitor and an anode of a light emitting diode at a third node, and a cathode of the light emitting diode is connected to a first reference potential line to receive a first reference voltage; and wherein a second terminal of the second capacitor is connected to a common ground.

15. The display device as claimed in claim 14, wherein the first to fifth electrical switches are thin film transistors.

16. The display device as claimed in claim 15, wherein the first to fifth electrical switches are indium gallium zinc oxide (IGZO) thin film transistors.

17. The display device as claimed in claim 14, wherein the first to fifth electrical switches are NPN field effect transistors.

18. The display device as claimed in claim 17, wherein the control terminals, the first terminals, and the second terminals of the first to fifth electrical switches are gates, drains, and sources, respectively.

19. The display device as claimed in claim 14, wherein the third scan signal is a row scan signal.

20. The display device as claimed in claim 14, wherein the first reference voltage is 0V.

* * * * *